US007992862B2

(12) United States Patent
Kuo

(10) Patent No.: US 7,992,862 B2
(45) Date of Patent: Aug. 9, 2011

(54) SHEET SIZE DETECTING MECHANISM FOR USE IN AUTOMATIC DOCUMENT FEEDER

(75) Inventor: Ping-Hung Kuo, Taipei (TW)

(73) Assignee: Primax Electronics, Ltd., Taipei (TW)

( * ) Notice: Subject to any disclaimer, the term of this patent is extended or adjusted under 35 U.S.C. 154(b) by 0 days.

(21) Appl. No.: 12/695,074

(22) Filed: Jan. 27, 2010

(65) Prior Publication Data

US 2011/0127714 A1 Jun. 2, 2011

(30) Foreign Application Priority Data

Nov. 27, 2009 (TW) ..... 98140528 A

(51) Int. Cl.
*B65H 1/00* (2006.01)

(52) U.S. Cl. ..... 271/171

(58) Field of Classification Search ..... 271/171, 271/145

See application file for complete search history.

(56) References Cited

U.S. PATENT DOCUMENTS

| | | | | |
|---|---|---|---|---|
| 4,607,834 | A * | 8/1986 | Dastin | 271/171 |
| 5,251,889 | A * | 10/1993 | Spencer et al. | 271/171 |
| 5,743,522 | A * | 4/1998 | Rubscha et al. | 271/265.02 |
| 6,254,085 | B1 * | 7/2001 | Kang | 271/171 |
| 6,454,254 | B2 * | 9/2002 | Yamaguchi et al. | 271/171 |
| 7,740,553 | B2 * | 6/2010 | Salomon et al. | 474/111 |
| 2003/0151188 | A1 * | 8/2003 | Imahara | 271/171 |
| 2005/0051947 | A1 * | 3/2005 | Furukawa | 271/171 |
| 2009/0066011 | A1 * | 3/2009 | Ohno et al. | 271/171 |

FOREIGN PATENT DOCUMENTS

| | | |
|---|---|---|
| JP | 60209443 | * 10/1985 |
| JP | 02239033 | * 9/1990 |
| JP | 04106026 | * 4/1992 |
| JP | 06127704 | * 5/1994 |

* cited by examiner

*Primary Examiner* — Kaitlin S Joerger
*Assistant Examiner* — Patrick Cicchino
(74) *Attorney, Agent, or Firm* — Apex Juris pllc; Tracy M. Heims

(57) ABSTRACT

A sheet size detecting mechanism includes an adjustable module, a sensing module and a controlling unit. The adjustable module includes a first sheet guide, a second sheet guide, an adjustable part and a circular gear. The adjustable part is a moved to a position where the first sheet guide and the second sheet guide are respectively in contact with two parallel edge sides of a sheet. The circular gear is rotated as the adjustable part is moved. The sensing module includes a sustaining element and a circuit board. The sustaining element is connected to an underside of the circular gear, and synchronously rotated with the circular gear. When the circular gear is rotated by an angle, the sustaining element is in contact with a specified one of the plural sensing regions, so that the circuit board generates a sensing signal. According to the sensing signal, the sheet size is acquired.

4 Claims, 7 Drawing Sheets

SHEET SIZE DETECTING MECHANISM FOR USE IN AUTOMATIC DOCUMENT FEEDER

FIELD OF THE INVENTION

The present invention relates to a sheet size detecting mechanism, and more particularly to a sheet size detecting mechanism for use in an automatic document feeder.

BACKGROUND OF THE INVENTION

With the maturity of automatic sheet feeding technologies, automatic document feeders are widely used in a diversity of document processing machines such as printers, copiers and multifunction peripherals. An automatic document feeder is used for successively feeding a stack of sheet-like documents into the inner portion of the document processing machine so as to implement associated operations and achieve the labor-saving purpose.

For processing sheet-like documents of various sizes, the automatic document feeder has a sheet size detecting mechanism for detecting the size of the document before the document is fed into the inner portion of the document processing machine. Take a copier for example. There are several paper feeding cassettes accommodating blank paper sheets of various sizes (A3, A4, B4, B5, . . . , etc). For example, in a case that an A4-sized document is selected to be copied by the copier, the sheet size detecting mechanism will detect the size of document in advance and issue a corresponding detecting signal to the copier. In response to the detecting signal, an A4-sized blank paper sheet is automatically provided by the copier, and a copying operation is performed on the A4-sized blank paper sheet.

FIG. 1 is a schematic perspective view illustrating a sheet size detecting mechanism disclosed in Taiwanese Patent No. 00588545. FIG. 2 is a schematic top view illustrating a logic plate and a sensing module of the sheet size detecting mechanism as shown in FIG. 1. As shown in FIGS. 1 and 2, the sheet size detecting mechanism comprises a sheet input tray 11, a logic plate 12 and a sensing module 13. The sheet input tray 11 comprises a sheet holder 111 and two opposed sheet guides 112 and 113. The relative location between the sheet guides 112 and 113 is adjustable. As such, the sheet guides 112 and 113 are close to or far from each other to clamp both sides of the paper sheet. The sensing module 13 is fixed under the sheet input tray 11. The logic plate 12 is connected to the sheet guide 113. As such, the logic plate 12 and the sheet guide 113 may be synchronously moved. The logic plate 12 is strip-shaped, and plural featured structures 121 are formed on the surface of the logic plate 12. By moving the sheet guide 113 to comply with the sheet width, a relative motion between the logic plate 12 and the sensing module 13 is rendered and plural digital signals are generated. According to the digital signals, the sheet size is determined. This sheet size detecting mechanism, however, still has some drawbacks. For example, the strip-shaped logic plate 12 is costly. In addition, the use of the logic plate 12 occupies much space of the sheet input tray 11.

For solving the above drawbacks, a sheet size detecting mechanism for saving space of the sheet input tray is disclosed in for example U.S. Pat. No. 6,070,048. FIG. 3 is a schematic perspective view illustrating a sheet size detecting mechanism disclosed in U.S. Pat. No. 6,070,048. As shown in FIG. 3, the sheet size detecting mechanism 4 comprises a sheet guide 41 with racks 411, a circular gear 42 and a variable resistor 43. The racks 411 of the sheet guide 41 are engaged with the circular gear 42. The circular gear 42 is connected with the variable resistor 43. As such, the circular gear 42 and the variable resistor 43 are synchronously rotated. When the sheet guide 41 is moved to comply with the sheet size, the circular gear 42 is correspondingly rotated and thus the variable resistor 43 generates an output resistance value. The output resistance value is varied according to the rotating amount of the circular gear 42. That is, the sheet size may be detected according to the output resistance value. Since the variable resistor 43 is not cost-effective, the sheet size detecting mechanism is still unsatisfied.

SUMMARY OF THE INVENTION

The present invention relates to a sheet size detecting mechanism, and more particularly to a sheet size detecting mechanism for saving space and cost.

In accordance with an aspect of the present invention, there is provided a sheet size detecting mechanism for use in a sheet input tray of an automatic document feeder. The sheet size detecting mechanism includes an adjustable module, a sensing module and a controlling unit. The adjustable module is disposed on the sheet input tray. The adjustable module includes a first sheet guide, a second sheet guide, an adjustable part and a circular gear. The first sheet guide arranged at a first side of the adjustable module. The second sheet guide arranged at a second side of the adjustable module. The adjustable part includes a rack member. The rack member is a moved to a position where the first sheet guide and the second sheet guide are respectively in contact with two parallel edge sides of a sheet. The circular gear is engaged with the rack member and rotated as the adjustable part is moved. The sensing module is used for sensing a rotating angle of the circular gear. The sensing module includes a sustaining element and a circuit board. The sustaining element is disposed under the circular gear, and synchronously rotated with the circular gear. The circuit board includes a circular sensing part with plural sensing regions, which are discretely arranged around the circular sensing part. When the circular gear is rotated by an angle, the sustaining element is in contact with a specified one of the plural sensing regions, so that the circuit board generates a corresponding sensing signal. The controlling unit is used for receiving the sensing signal and acquiring a distance between the two parallel edge sides of the sheet according to the sensing signal.

In an embodiment, the sensing signal is a current value.

In an embodiment, the sustaining element includes a first pin and a second pin, the circular sensing part further includes an annular region, and the controlling unit provides a voltage to the circuit board. When the first pin is in contact with the annular region and the second pin is in contact with the specified one of the plural sensing regions, the circular sensing part provides a resistance value, so that the circuit board generates a corresponding current value.

In an embodiment, the sustaining element is made of elastomeric material, so that the first pin and the second pin are elastically sustained against the annular region and the specified one of the plural sensing regions, respectively.

In an embodiment, the rack member includes a first rack and a second rack. The first rack is connected to the first sheet guide. The second rack is connected to the second sheet guide, and in parallel with the first rack. The circular gear is arranged between the first rack and the second rack, and engaged with the first rack and the second rack. When the first rack is moved in a direction, the circular gear is driven to rotate. In response to rotation of the circular gear, the second rack is moved in another direction reverse to the first rack.

In an embodiment, the sheet size detecting mechanism further includes a sensor. The sensor is disposed on the sheet input tray for detecting whether the other two parallel edge sides of the sheet is greater than a predetermined length.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
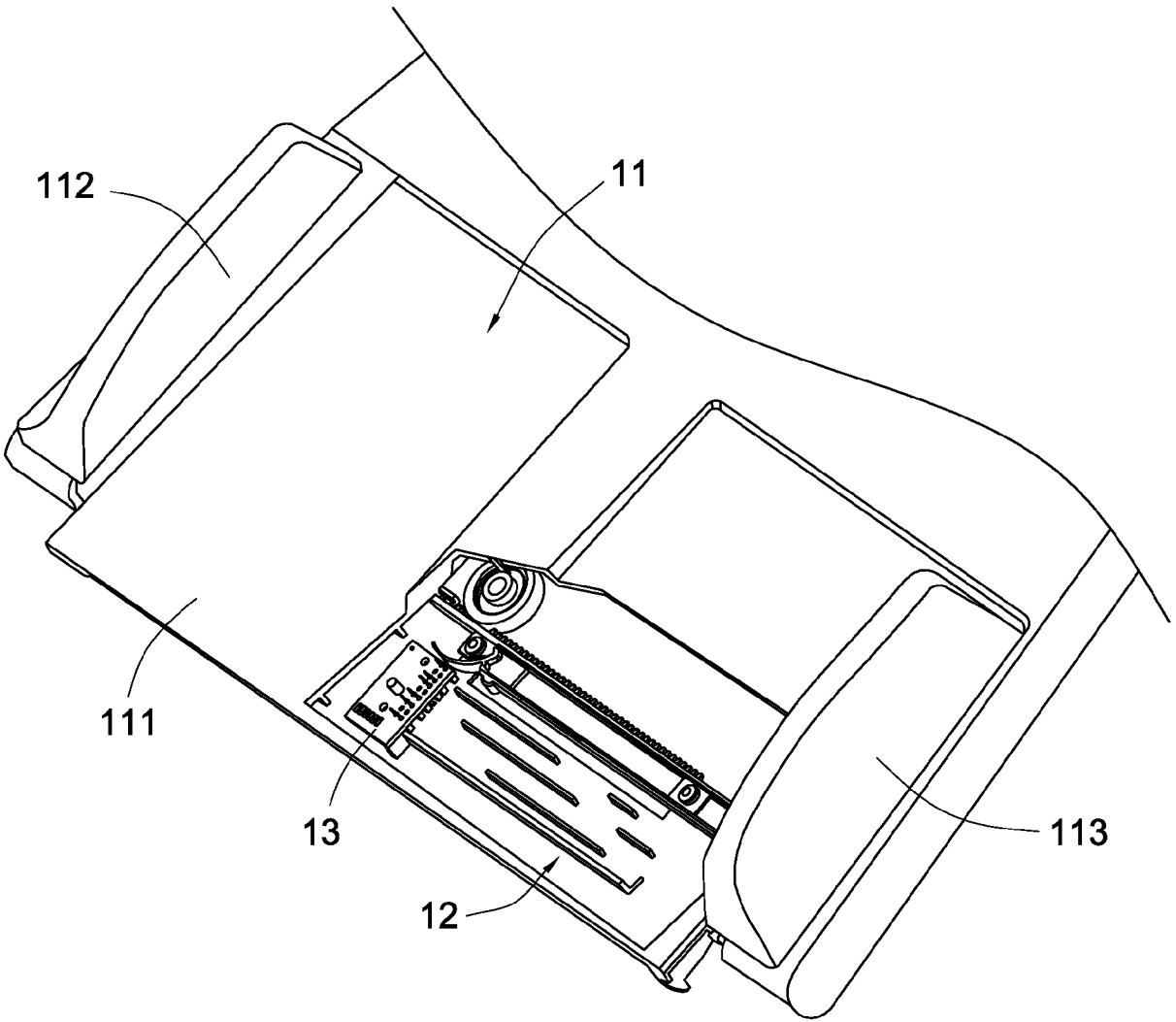
FIG. 1(PRIOR ART)
FIG. 1 is a schematic perspective view illustrating a sheet size detecting mechanism according to the prior art.
Figure 2:
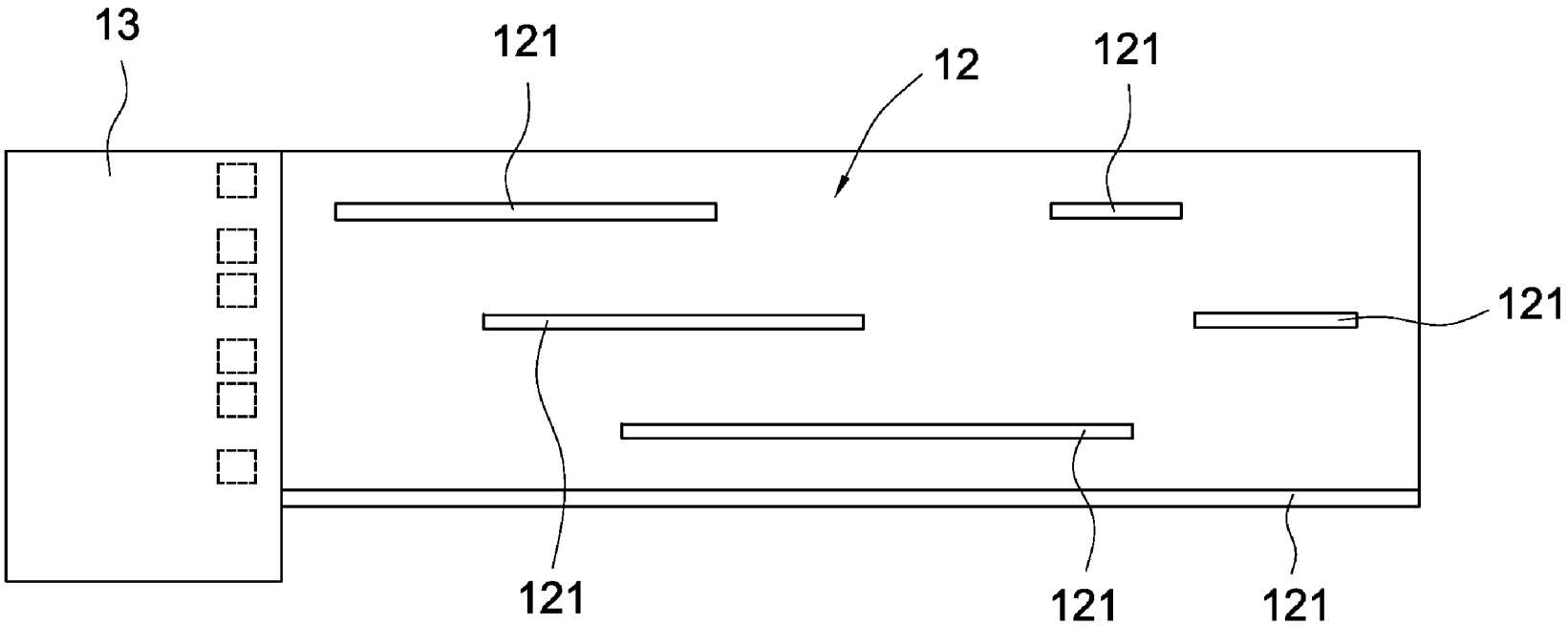
FIG. 2(PRIOR ART)
FIG. 2 is a schematic top view illustrating a logic plate and a sensing module of the sheet size detecting mechanism as shown in FIG. 1.
Figure 3:
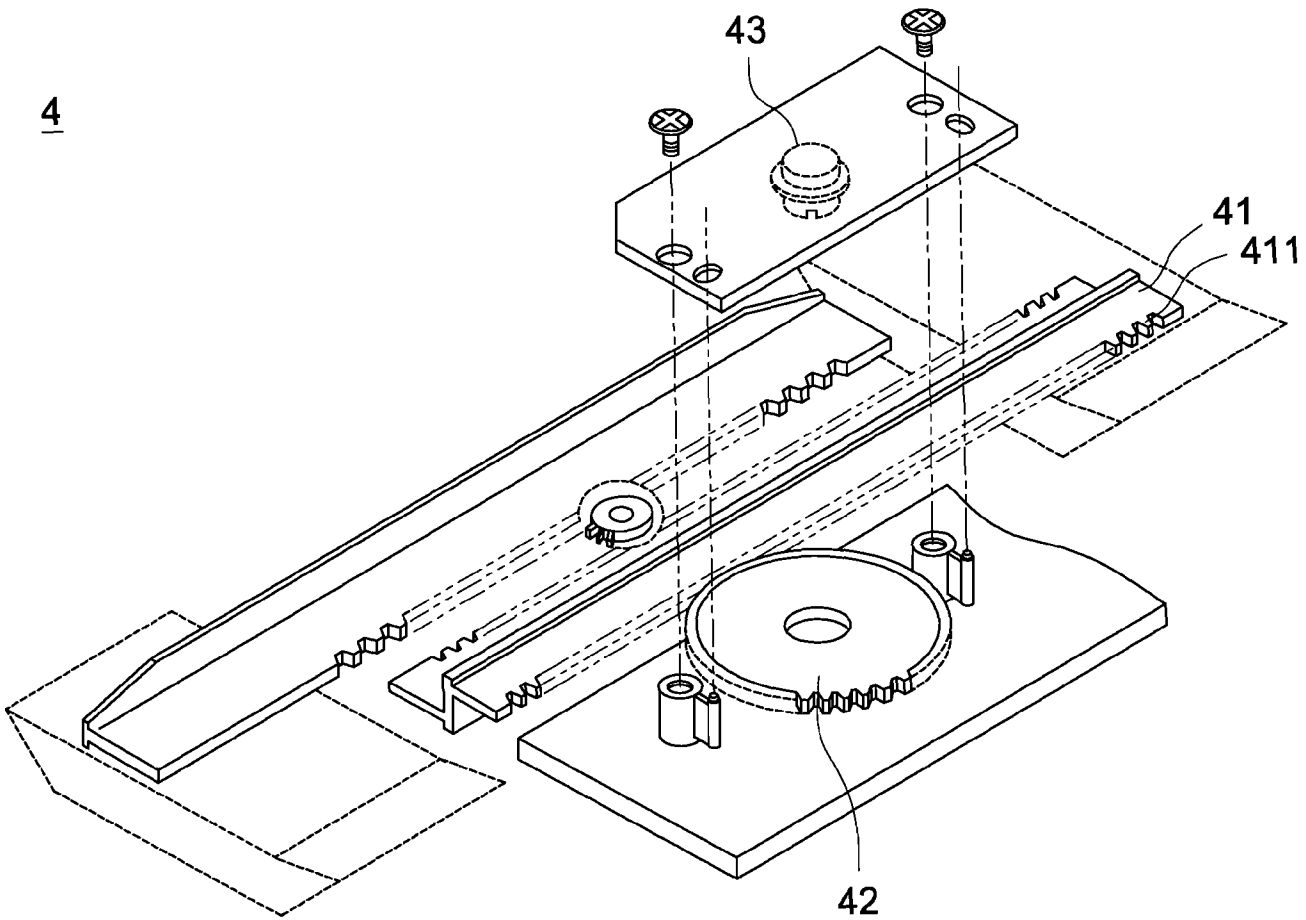
FIG. 3(PRIOR ART)
FIG. 3 is a schematic perspective view illustrating another sheet size detecting mechanism according to the prior art.
Figure 4:
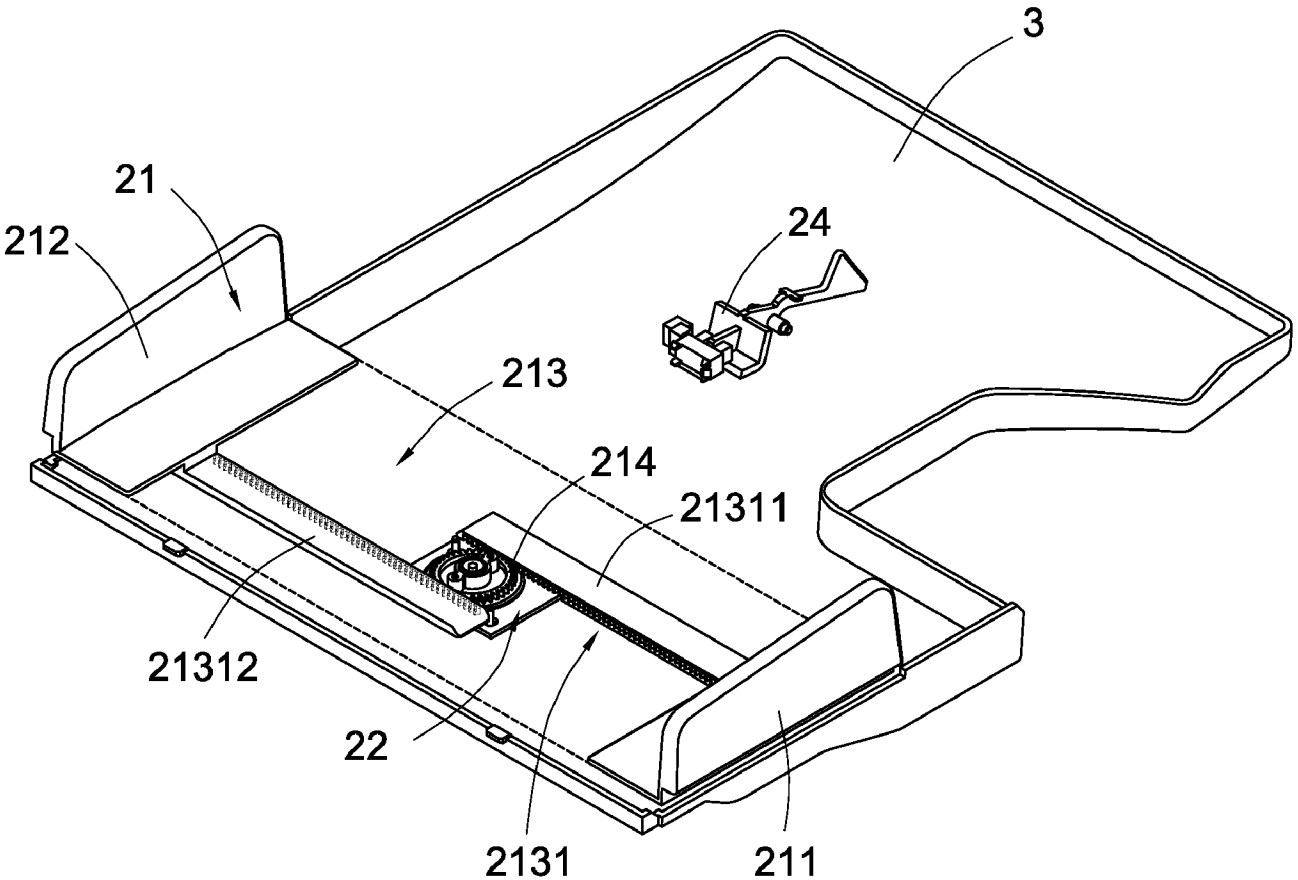
FIG. 4 is a schematic perspective view illustrating a sheet size detecting mechanism according to an embodiment of the present invention.

FIG. 4 is a schematic perspective view illustrating a sheet size detecting mechanism according to an embodiment of the present invention. The sheet size detecting mechanism 2 is applied to a sheet input tray 3 of an automatic document feeder. The sheet size detecting mechanism 2 comprises an adjustable module 21, a sensing module 22 and a controlling unit 23 (see FIG. 7). The adjustable module 21 comprises a first sheet guide 211, a second sheet guide 212, an adjustable part 213 and a circular gear 214. The first sheet guide 211 is arranged at a first side of the adjustable module 21. The second sheet guide 212 is arranged at a second side of the adjustable module 21. The adjustable part 213 comprises a rack member 2131. The rack member 2131 comprises a first rack 21311 and a second rack 21312. The first rack 21311 and the second 21312 are respectively connected to the first sheet guide 211 and the second sheet guide 212. In addition, the first rack 21311 and the second rack 21312 are parallel with each other. The circular gear 214 is arranged between the first rack 21311 and the second rack 21312, and engaged with the first rack 21311 and the second rack 21312.

Figure 5:
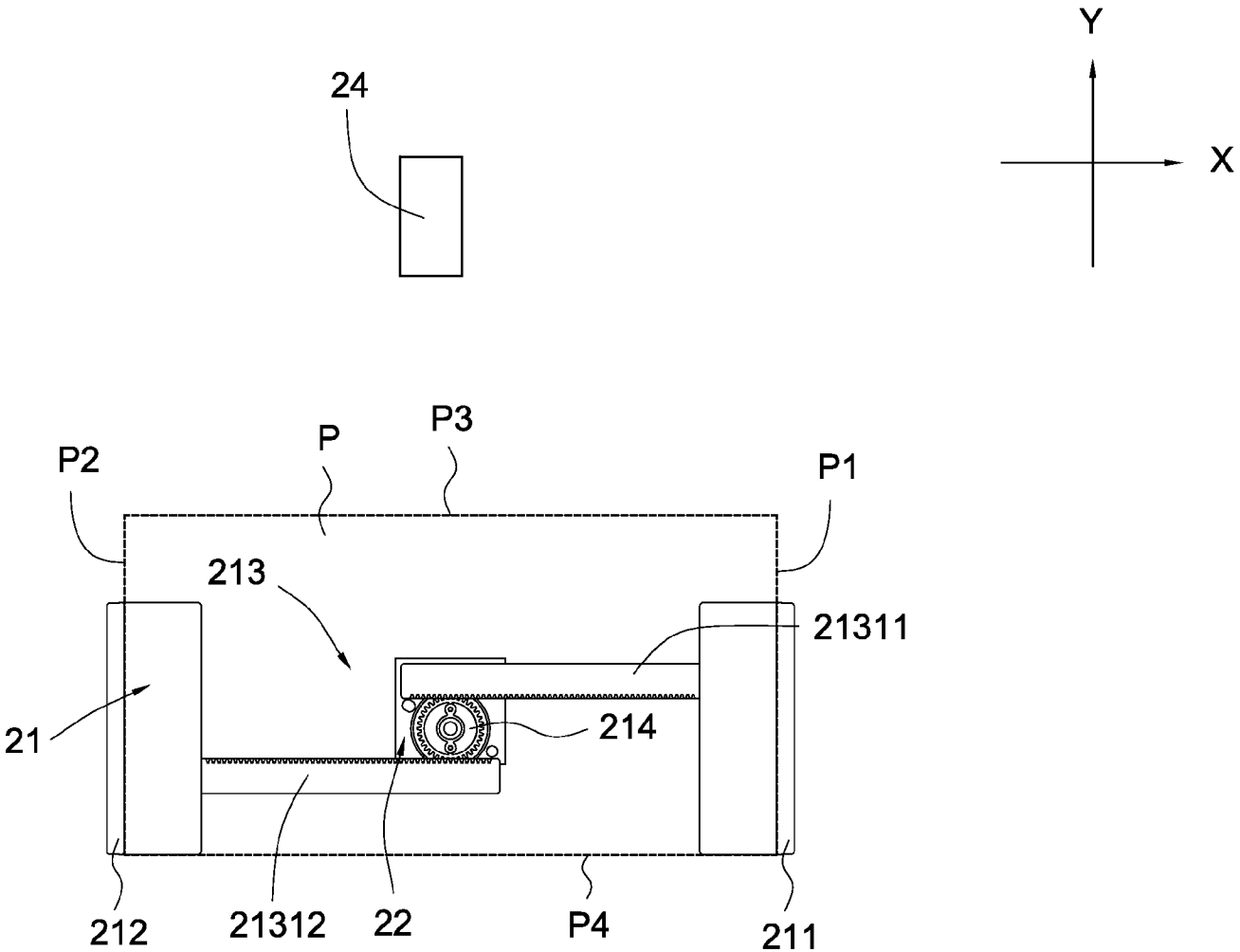
FIG. 5 is a schematic top view illustrating the sheet size detecting mechanism of FIG. 4.

FIG. 5 is a schematic top view illustrating the sheet size detecting mechanism of FIG. 4. For placing a sheet P on the sheet input tray 3, the user may move the first sheet guide 211 in the X-axis direction. As such, the first rack 21311 is synchronously moved with the first sheet guide 211 and the circular gear 214 is rotated with the linear motion of the first rack 21311. Upon rotation of the circular gear 214, the second rack 21312 is synchronously moved in the negative X-axis direction. In other words, by moving the first sheet guide 211, the first rack 21311 and the second rack 21312 are synchronously moved in reverse directions. The first sheet guide 211 and the second sheet guide 212 may be synchronously moved to be close to or far from each other until the first sheet guide 211 and the second sheet guide 212 are in contact with two parallel edge sides P1 and P2 of the sheet P, respectively. Similarly, by moving the second sheet guide 212 in the X-axis direction, the first sheet guide 211 and the second sheet guide 212 will be in contact with two parallel edge sides P1 and P2 of the sheet P, respectively.

Since the circular gear 214 is rotated with movement of the first sheet guide 211 or the second sheet guide 212, the rotating amount of the circular gear 214 is in direct proportion to the shift amount of the first sheet guide 211 or the second sheet guide 212. According to the proportional relationship between the rotating amount of the circular gear 214 and the shift amount of the first sheet guide 211 or the second sheet guide 212, the distance between the two parallel edge sides P1 and P2 of the sheet P could be deduced.

Figure 6:
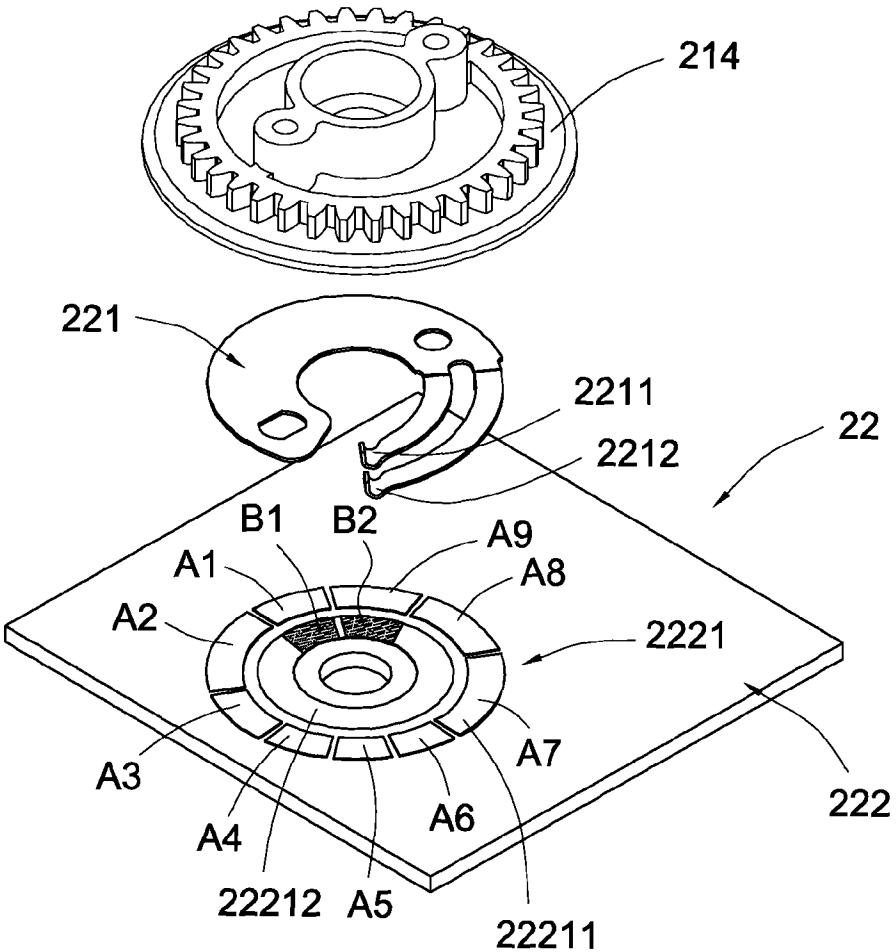
FIG. 6 is a schematic exploded view illustrating the circular gear and the sensing module of the sheet size detecting mechanism as shown in FIG. 4.

FIG. 6 is a schematic exploded view illustrating the circular gear and the sensing module of the sheet size detecting mechanism as shown in FIG. 4. As shown in FIG. 6, the sensing module 22 comprises a sustaining element 221 and a circuit board 222. The sustaining element 221 is connected to the underside of the circular gear 214, so that the sustaining element 221 could be synchronously rotated with the circular gear 214. The sustaining element 221 comprises a first pin 2211 and a second pin 2212. The circuit board 222 comprises a circular sensing part 2221. The circular sensing part 2221 has plural sensing regions 22211 and an annular region 22212. The sensing regions 22211 are discretely arranged around the circular sensing part 2221. The first pin 2211 is in contact with the annular region 22212. The second pin 2212 is in contact with one of the plural sensing regions 22211. Moreover, the sustaining element 221 is made of elastomeric material. Due to the elasticity of the elastomeric material of the sustaining element 221, the first pin 2211 and the second pin 2212 are elastically sustained against the annular region 22212 and a specified sensing region 22211, respectively.

Moreover, regardless of the rotating amount of the circular gear 214, the first pin 2211 is continuously in contact with the annular region 22212. According to the rotating amount of the circular gear 214, the second pin 2212 is in contact with a specified one of the plural sensing regions 22211. In this embodiment, the circular sensing part 2221 comprises nine sensing regions A1-A9. In a case that the first sheet guide 211 and the second sheet guide 212 are spaced from each other by the maximum distance, an initial position is defined. Meanwhile, the first pin 2211 is in contact with the region B1 of the annular region 22212, and the second pin 2212 is contact with the sensing region A1. By moving the first sheet guide 211 toward the second sheet guide 212, the first sheet guide 211 and the second sheet guide 212 are close to each other. At the same time, the sustaining element 221 is synchronously rotated with the circular gear 214. Upon rotation of the sustaining element 221, the second pin 2212 is no longer in contact with the sensing region A1. Until the circular gear 214 stops rotation, the second pin 2212 is in contact with one of the sensing region A2, A3, . . . , and A9 according to the rotating amount of the circular gear 214. In a case that the first sheet guide 211 and the second sheet guide 212 are spaced from each other by the minimum distance, the first pin 2211 is in contact with the region B2 of the annular region 22212 and the second pin 2212 is in contact with the sensing region A9.

Figure 7:
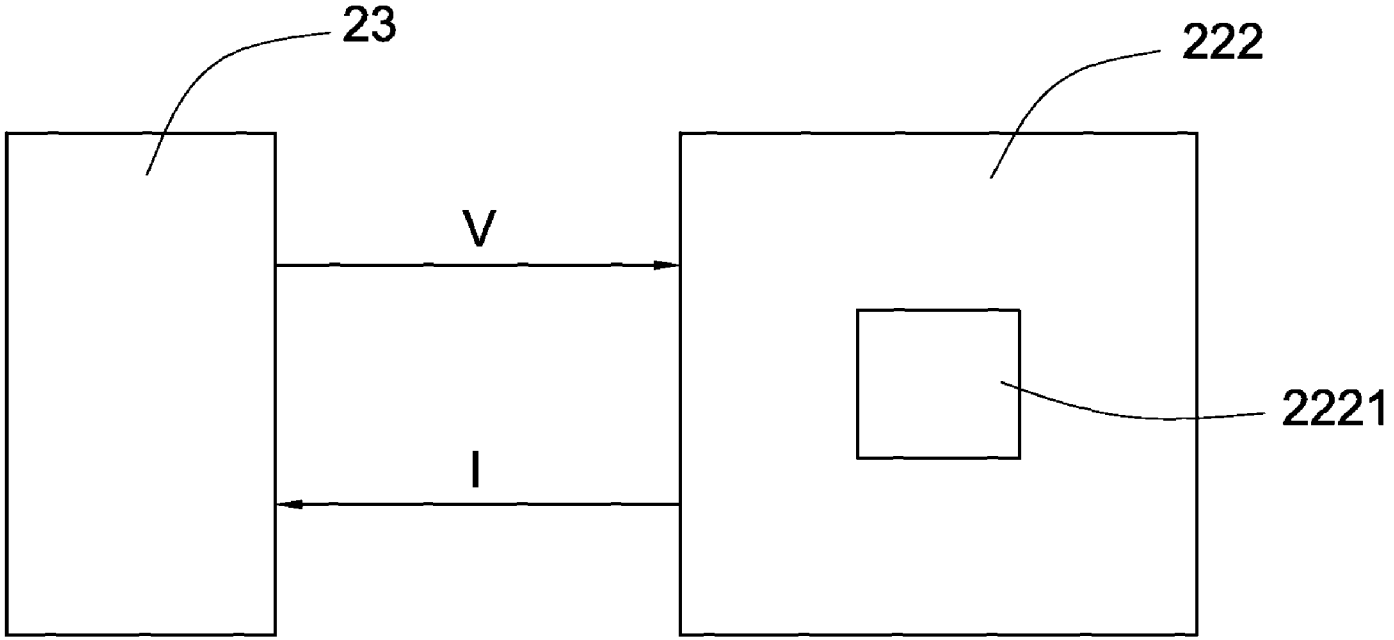
FIG. 7 is a schematic circuit block diagram illustrating a sheet size detecting mechanism according to an embodiment of the present invention.

FIG. 7 is a schematic circuit block diagram illustrating a sheet size detecting mechanism according to an embodiment of the present invention. The controlling unit 23 of the sheet size detecting mechanism 2 provides a constant voltage to the circuit board 222. As such, a constant voltage difference V is generated between the annular region 22212 and one of the plural sensing regions 22211. Once the first pin 2211 is in contact with the annular region 22212 and the second pin 2212 is in contact with one of the plural sensing regions 22211, the circular sensing part 2221 provides a resistance value, so that a current I is outputted from the circuit board 222 to the controlling unit 23. Moreover, the circular sensing part 2221 has different resistance values when the second pin 2212 is in contact with different sensing regions 22211. As the resistance value is varied, the current I is outputted from the circuit board 222 has different current values under the constant voltage difference V. According to the current value of the current I, the controlling unit 23 may discriminate which one of the sensing regions 22211 is in contact with the second pin 2212. Correspondingly, the rotating amount of the circular gear 214 is acquired. According to the rotating amount of the circular gear 214, the distance between the two parallel edge sides P1 and P2 of the sheet P could be deduced.

Please refer to FIGS. 4 and 5 again. In some embodiments, the sheet size detecting mechanism 2 further comprises a sensor 24. The sensor 24 is disposed on the sheet input tray 3 for assisting the controlling unit 23 in discriminating the size of the sheet P. In a case that the two parallel edge sides P1 and P2 of the sheet P are too close, the sensor 24 may further discriminate whether the distance between the other two parallel edge sides P3 and P4 of the sheet P in the Y-axis direction is greater than a predetermined length. For example, as known, the distance between the other two parallel edge sides P1 and P2 of the A4-sized sheet P that is transversely placed on the sheet input tray 3 is equal to the distance between the other two parallel edge sides P1 and P2 of the A3-sized sheet P that is longitudinally placed on the sheet input tray 3. If the sensor 24 detects presence of the paper P, it is meant that the sheet P on the sheet input tray 3 is an A3-sized sheet. Whereas, if the sensor 24 detects absence of the paper P, it is meant that the sheet P on the sheet input tray 3 is an A4-sized sheet.

From the above description, the sheet size detecting mechanism 2 of the present invention is capable of measuring the size of the sheet P. As the first sheet guide 211 and second sheet guide 212 are close to or far from each other, the circular gear 214 is correspondingly rotated. According to the rotating amount of the circular gear 214, the shift amount of the first sheet guide 211 and second sheet guide 212 is obtained and thus the size of the sheet P is measured. Moreover, if different rotating amount of the circular gear 214 are generated, the sustaining element 221 under the circular gear 214 is in contact with different sensing regions 22211. In different situations, different current values are received by the controlling unit 23. According to the current values, the distance between the two parallel edge sides P1 and P2 of the sheet P could be deduced. Since no variable resistor is used, the sheet size detecting mechanism 2 of the present invention is more cost-effective.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A sheet size detecting mechanism for use in a sheet input tray of an automatic document feeder, said sheet size detecting mechanism comprising:

an adjustable module disposed on said sheet input tray, and comprising:

a first sheet guide arranged at a first side of said adjustable module;

a second sheet guide arranged at a second side of said adjustable module;

an adjustable part comprising a rack member, wherein said rack member is moved to a position where said first sheet guide and said second sheet guide are respectively in contact with two parallel edge sides of a sheet; and a circular gear engaged with said rack member and rotated as said adjustable part is moved;

a sensing module for sensing a rotating angle of said circular gear, said sensing module comprising:

a sustaining element connected to an underside of said circular gear, and synchronously rotated with said circular gear wherein said sustaining element comprises a first pin and a second pin;

a circuit board comprising a circular sensing part with plural sensing regions, which are discretely arranged around said circular sensing part and where said circular sensing part further includes an annular region, wherein when said circular gear is rotated by an angle, said sustaining element is in contact with a specified one of said plural sensing regions, so that said circuit board generates a corresponding sensing signal and where said sensing signal is a current value; and a controlling unit for receiving said sensing signal and acquiring a distance between said two parallel edge sides of said sheet according to said sensing signal and where said controlling unit provides a voltage to said circuit board, wherein when said first pin is in contact with said annular region and said second pin is in contact with said specified one of said plural sensing regions, said circular sensing part provides a resistance value, so that said circuit board generates a corresponding current value.

2. The sheet size detecting mechanism according to claim 1 wherein said sustaining element is made of elastomeric material, so that said first pin and said second pin are elastically sustained against said annular region and said specified one of said plural sensing regions, respectively.

3. The sheet size detecting mechanism according to claim 1 wherein said rack member comprises:

a first rack connected to said first sheet guide; and a second rack connected to said second sheet guide, and in parallel with said first rack, wherein said circular gear is arranged between said first rack and said second rack, and engaged with said first rack and the second rack, wherein when said first rack is moved in a direction, said circular gear is driven to rotate, and in response to rotation of said circular gear, said second rack is moved in another direction reverse to said first rack.

4. The sheet size detecting mechanism according to claim 1 further comprising a sensor, which is disposed on said sheet input tray for detecting whether the other two parallel edge sides of said sheet is greater than a predetermined length.

* * * * *